US005109587A

United States Patent [19]

Kusch

[11] Patent Number: 5,109,587

[45] Date of Patent: May 5, 1992

[54] RUBBER COVERED ROLLER IN WHICH THE PHYSICAL STATE OF THE RUBBER AT THE END FACES THEREOF IS BETWEEN A RUBBER ELASTIC PHYSICAL STATE AND A GLASSLIKE PHYSICAL STATE

[75] Inventor: Hans-Jürgen Kusch, Neckargemünd, Fed. Rep. of Germany

[73] Assignee: Heidelberger Druckmaschinen AG, Heidelberg, Fed. Rep. of Germany

[21] Appl. No.: 365,255

[22] Filed: Jun. 12, 1989

[30] Foreign Application Priority Data

Jun. 10, 1988 [DE] Fed. Rep. of Germany ..... 3819802

[51] Int. Cl.[5] ..... B21B 31/08

[52] U.S. Cl. ..... 29/132; 29/110

[58] Field of Search ..... 29/110, 132, 130; 264/22; 102/350

[56] References Cited

U.S. PATENT DOCUMENTS 4,455,938 6/1984 Loudon .

OTHER PUBLICATIONS

Publication "8.6 Alterung als Zusammenfassung aller Einflüsse während der Anwendung", pp. 181 through 185, vol. 1, 1978.

"Konstruieren mit Kunststoffen" Part 1, 1972, pp. 693 and 694.

*Primary Examiner*—Irene Cuda

*Attorney, Agent, or Firm*—Herbert L. Lerner; Laurence A. Greenberg

[57] ABSTRACT

A rubber-covered roller includes a rod core, and a cylindrical covering on the core formed of rubber, the cylindrical covering having respective end faces at which the rubber is in a physical state formed by ultraviolet irradiation which is between a rubber-elastic physical state and a glasslike physical state.

2 Claims, 2 Drawing Sheets

Figure 1:
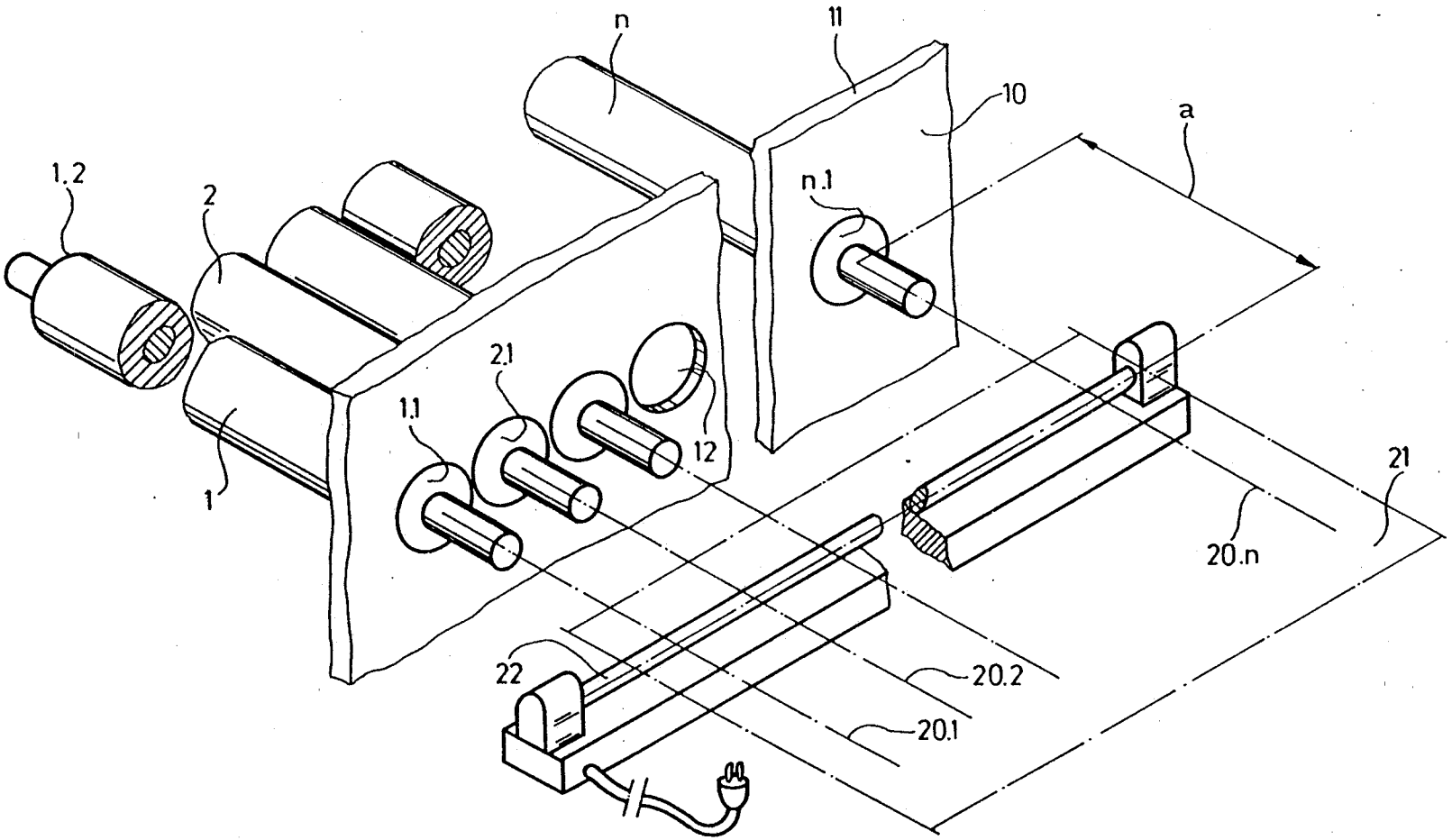

RUBBER COVERED ROLLER IN WHICH THE PHYSICAL STATE OF THE RUBBER AT THE END FACES THEREOF IS BETWEEN A RUBBER ELASTIC PHYSICAL STATE AND A GLASSLIKE PHYSICAL STATE

The invention relates to a rubber-covered roller for a roller pair, the rubber-covered roller being in engagement with another roller of the roller pair in a contact zone along common, outer-cylinder generating lines of the rubber-covered roller and of the other roller, and a supply of liquid enclosed by respective sealing means at the ends of the rollers in a nip or wedge-shaped space between the rollers and above the contact zone, each of the sealing means being in engagement, at least with respect to the rubber-covered roller, with an end face of a respective roller, and further to a method and device for transforming the physical state of the rubber-covered roller at the end faces thereof.

A roller pair of the foregoing general type has become known, for example, from U.S. Pat. No. 4,455,938, as forming a component of a dampening unit for an offset-printing press. In this regard, the applicator roller, which is furnished with an elastic surface, and which corresponds to the rubber-covered roller of the invention of the instant application, serves to apply dampening medium to a plate cylinder of the offset-printing press. A supply of dampening medium is enclosed by sealing means at the ends of the applicator roller and a metering roller, which is in engagement with the applicator roller, in the upper nip or wedge-shaped space between the applicator roller and the metering roller. The sealing means are formed at each end of the pair of rollers, by a sealing plate, which has a flat side with which it engages an end face of the applicator roller, and has an arcuately-shaped end face with which it engages the outer cylindrical surface of the metering roller, respectively, under the contact force of a spring.

Sealing plates of the foregoing general type are generally manufactured out of a plastic material with a low coefficient of friction, for example PTFE. In dampening units, metering rollers cooperating with sealing plates of this general type are generally provided at the ends thereof with steel rings, which are engaged by a respective arcuately shaped sealing-plate end face, so that relatively low wear occurs at the metering roller, and at the end face of the sealing plate, especially if plasma-coated steel rings are used.

In the end-face sealing of an applicator roller formed as a rubber-covered roller, very high friction forces are produced, however, due to the required contact force of the sealing plate and the high coefficient of friction of the rubber. These friction forces cause an impermissible rise in temperature, which, at high machine speed, may result in temperatures of up to 130° C., and to heavy wear both of the rubber-covered roller and of the sealing plate, and may even result in the destruction thereof. The required sealing is thereby no longer assured.

It is accordingly an object of the invention to ensure the sealing of a rubber-covered roller at its end faces, over an extended period of time by means of sealing plates, which are in engagement with the end faces.

With the foregoing and other objects in view, there is provided, in accordance with one aspect of the invention, a rubber-covered roller comprising a rod-like core, and a cylindrical covering on the core formed of rubber, the cylindrical covering having respective end faces at which the rubber is in a physical state formed by ultraviolet irradiation which is between a rubber-elastic physical state and a glasslike physical state.

In accordance with another aspect of the invention, there is provided in an assembly of a roller pair, having rollers mutually engaging in a contact zone along common outer cylinder generating lines of each of the rollers, a sealing device at respective ends of the roller pair, and a supply of liquid enclosed by the sealing devices in a nip between the rollers and above the contact zone, each of the sealing devices being in engagement with an end face of at least one of the rollers, a cylindrical covering of rubber formed on one of the rollers and having the respective end faces in engagement with the respective sealing devices, the rubber at the respective end faces being in a physical state formed by ultraviolet irradiation which is between a rubber-elastic physical state and a glasslike physical state.

In accordance with a further aspect of the invention, there is provided a method of transforming rubber having a hardness of substantially 50 to 60 Shore at end faces of a roller having a covering formed of the rubber, which comprises installing a black-light lamp generating ultraviolet radiation having a wavelength of substantially 300 to 400 nm at a distance of substantially 10 cm from a respective end face of the rubber-covered roller, the lamp having an installed power of substantially 0.1 watt per square centimeter of the respective end face, and exposing each of the respective end faces of the rubber-covered roller over a period of substantially 60 hours to the ultraviolet radiation, and simultaneously shielding the outer cylindrical surface of the rubber-covered roller against the ultraviolet radiation.

In accordance with an additional aspect of the invention, there is provided, a device for performing a method of transforming rubber having a hardness of substantially 50 to 60 Shore at end faces of a plurality of rollers having respective coverings formed of the rubber, comprising a rod-shaped black-light lamp disposed alongside a plane in which respective end faces of the plurality of rollers are disposed, the rod-shaped lamp having a longitudinal axis disposed parallel to the first plane, the rod-shaped lamp being substantially 10 cm from the end faces in the plane and having an installed power of substantially 0.1 watt per square centimeter of each of the end faces in the plane.

In accordance with a concomitant feature of the invention, respective opposite end faces of the plurality of rubber-covered rollers are disposed in another plane, and the device includes the respective opposite end faces of the plurality of rubber-covered rollers which are disposed in the other plane, and another rod-shaped black-light lamp having a longitudinal axis disposed parallel to the other plane, the other rod-shaped lamp being also substantially 10 cm from the end faces in the other plane and having an installed power with respect to the end faces in the other plane similar to that of the first-mentioned rod-shaped lamp with respect to the end faces in the first-mentioned plane.

In cases of the prior art, wherein rubber or rubber elastic materials are used, advantage is always taken of the special elasticity and/or relatively high coefficient of friction of those materials. When elasticity decreases and embrittlement occurs, components made of such materials, such as sealing rings or buffers, for example, are replaced by new ones.

Elasticity, amongst other things, is likewise a decisive factor for using rubber for an applicator roller of a dampening unit of an offset-printing press. The fact that rubber has been known as a preferred sealing material, has led applicant to expect that satisfactory results would be achieved in the end-face sealing of an applicator roller which is in the form of a rubber-covered roller.

The method according to the invention serves to retain the elasticity of the outer cylindrical surface of the applicator roller while departing from the concept of exploiting the elasticity and the relatively high coefficient of friction in order to achieve sealing, by providing reduced elasticity and a reduced coefficient of friction in the end faces of the rubber-covered roller which are to be sealed.

For this purpose, the invention takes advantage of a physical state of rubber which is undesirable in the prior art and provides this physical state at the end faces of the rubber-covered roller.

A physical state of rubber which is undesired in the prior art is one which lies between a rubber elastic physical state and a glasslike physical state and occurs with advanced molecular cross-linking, which is accompanied by an increasing hardening of the rubber and an increasing smoothening of its surface. The invention makes use of these properties, which are characteristic signs of aging. In this regard, an artificially shortened aging process is provided locally at the end faces of the rubber-covered roller and the resulting hardening and smoothing of the end faces are utilized for improving the wear resistance thereof and for reducing the resistance thereof to friction, while the rubber-elastic qualities of the remaining regions of the rubber-covered roller are retained.

The artificially shortened aging process is caused by ultraviolet (UV) irradiation, in accordance with the invention. This is restricted, furthermore, to the end faces of the rubber-covered rollers, in accordance with the invention.

Due to the increased resistance to wear and the smoothened surface, the artificially aged end faces of the rubber-covered roller provided in accordance with the invention ensure the end-face sealing of the rubber-covered roller by sealing plates which are in engagement with the end faces thereof, the sealing being effected over an extended time period and at relatively high rotational speeds of the rubber-covered roller.

In the case of a rubber-covered roller with a hardness in the order of magnitude of 50 to 60 Shore, favorable sealing properties are achieved in conjunction with sealing plates, which are in engagement with the end faces of the rubber-covered roller, if the end faces are exposed to UV radiation having a wavelength of approximately 300 to 400 nm over a time period in the order of magnitude of 60 hours, with the outer cylindrical surface of the rubber-covered roller being shielded from the UV radiation. The UV radiation is produced by a so-called black-light lamp having an installed power in the order of magnitude of 0.1 watt per square centimeter of an end face and with the black-light lamp being disposed at a distance in the order of magnitude of 10 cm from the respective end face to be irradiated.

Other features which are considered as characteristic for the invention are set forth in the appended claims.

Although the invention is illustrated and described herein as embodied in a rubber covered roller and method and device for transforming the physical state of the rubber covered roller at the end faces thereof, it is nevertheless not intended to be limited to the details shown, since various modifications and structural changes may be made therein without departing from the spirit of the invention and within the scope and range of equivalents of the claims.

Figure 2:
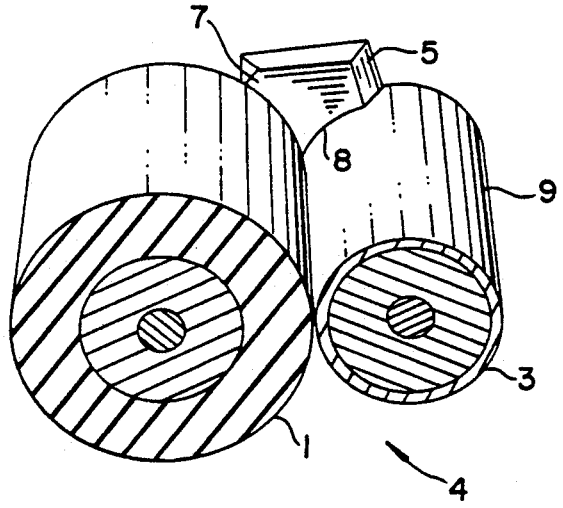

The construction and method of operation of the invention, however, together with additional objects and advantages thereof will be best understood from the following description of specific embodiments when read in connection with the accompanying drawings, in which:

FIG. 1 is a perspective view of a device for performing the method of transforming the physical state of the rubber-covered roller at the end faces thereof, in accordance with the invention; and FIG. 2 is a perspective view of a dampening unit in which the rubber-covered roller is incorporated.

Referring now to the drawings, and first particularly to FIG. 1 thereof, there are shown therein first end faces 1.1, 2.1, . . . , n.1 of a plurality of rubber-covered rollers 1, 2, . . . , n disposed in a first plane represented by an outer surface 10 of a shielding 11 for the outer cylindrical surfaces of the rubber-covered rollers 1, 2, . . . , n against ultraviolet (UV) radiation. The shielding 11 is formed with openings 12, which match the respective diameter of the rubber-covered rollers 1, 2, . . . , n. The rubber-covered rollers 1, 2, . . . , n have longitudinal axes 20.1, 20.2, . . . , 20.n which lie in an imaginary second plane 21. A rod-shaped black-light lamp 22 is also disposed in the plane 21 parallel to the outer surface 10 of the shielding 11 at a distance a from the end faces 1.1, 2.1, . . . , n.1 of the rubber-covered roller 1, 2, . . . , n. The shielding 11 protects the outer cylindrical surfaces of the rubber-covered rollers 1, 2, . . . , n from the UV radiation emitted by the black-light lamp 22.

When applying the device shown in FIG. 1 of the drawing, there is produced a condition of the end face of a rubber-covered roller, which is desirable for the end-face sealing according to the invention, namely a condition exhibiting a hardness in the order of magnitude of 50 to 60 Shore, when the device has a black-light tube approximately 120 cm in length with a power of approximately 36 watts which is disposed at a distance a of approximately 10 cm, the black-light tube being assigned to the end faces of a number $n=15$ rubber-covered rollers having a diameter of approximately 60 mm, and a period of irradiation of approximately 60 hours being provided.

In this connection, the black-light tube has an installed power in the order of magnitude of 0.1 watt per square centimeter of an end face of a rubber-covered roller.

As noted hereinbefore, FIG. 1 of the drawing shows a device for implementing the aforedescribed process, which permits irradiation of the respective first end faces 1.1, 2.1, . . . , n of the rubber-covered rollers 1, 2, . . . , n. A corresponding device may also be provided for the second end faces 1.2 of the rubber-covered rollers 1, 2, . . . , n and may be used simultaneously with the illustrated device, so that a transformation of the physical state may occur simultaneously at both end faces of a plurality of rubber-covered rollers, in accordance with the invention.

As noted in the introduction to this specification and as shown in FIG. 2, the rubber-covered roller 1, for example, serving as a dampening medium applicator roller, and a metering roller 3 form a roller pair in a dampening unit 4 of an offset-printing press. A supply of dampening medium is receivable in the upper nip or wedge-shaped space between the applicator roller 1 and the metering roller 3 which are in engagement with one another and enclosed at opposite ends of the rollers 1 and 3 by sealing plates 5 which, respectively, have a flat side 7 in engagement with an end face of the applicator roller 1, and an arcuately-shaped end face engaging the outer cylindrical surface 9 of the metering roller 3.

The foregoing is a description corresponding in substance to German Application P 3819802.9, dated Jun. 10, 1988, the International priority of which is being claimed for the instant application, and which is hereby made part of this application. Any material discrepancies between the foregoing specification and the aforementioned corresponding German application are to be resolved in favor of the latter.

I claim:

1. A rubber-covered roller comprising a rod-like core, and a cylindrical covering on said core formed of rubber predominately in a rubber elastic state, said cylindrical covering having respective end faces at which the rubber is in a physical state formed by ultraviolet irradiation which is between the rubber-elastic physical state and a glasslike physical state.

2. A rubber covered roller according to claim 1 wherein the rubber at said respective end faces of said cylindrical covering is in a physical state formed by the application thereto of ultraviolet radiation having a wavelength of substantially 300 to 400 nm from a source located at a distance of substantially 10 cm from the rubber for a period of substantially 60 hours, the source having an installed power of substantially 0.1 watt per square centimeter.

* * * * *